US009512718B2

(12) United States Patent
von Schoenebeck et al.

(10) Patent No.: US 9,512,718 B2
(45) **Date of Patent: *Dec. 6, 2016**

(54) DRUM HOUSING FOR A WORKING DRUM OF A CONSTRUCTION MACHINE OR MINING MACHINE, CONSTRUCTION MACHINE OR MINING MACHINE, AS WELL AS METHOD FOR MONITORING THE CONDITION OF A WORKING DRUM OF A CONSTRUCTION MACHINE OR MINING MACHINE

(71) Applicant: Wirtgen GmbH, Windhagen (DE)

(72) Inventors: Winfried von Schoenebeck, Kalenborn (DE); Joerg Berges, Hennef (DE); Peter Berghoff, Windhagen (DE); Stefan Wagner, Bad Honnef (DE); Cyrus Barimani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 8 days.

This patent is subject to a terminal disclaimer.

(21) Appl. No.: 14/606,079

(22) Filed: Jan. 27, 2015

(65) Prior Publication Data

US 2015/0192012 A1 Jul. 9, 2015

Related U.S. Application Data

(63) Continuation of application No. 14/016,682, filed on Sep. 3, 2013, now Pat. No. 8,944,518.

(30) Foreign Application Priority Data

Sep. 13, 2012 (DE) ..... 10 2012 216 262

(51) Int. Cl.
*E01C 23/088* (2006.01)
*E21C 35/00* (2006.01)
(Continued)

(52) U.S. Cl.
CPC ..... *E21C 25/06* (2013.01); *E01C 23/088* (2013.01); *E01C 23/12* (2013.01); *E21C 35/00* (2013.01)

(58) Field of Classification Search
CPC ..... E01C 23/088
See application file for complete search history.

(56) References Cited

U.S. PATENT DOCUMENTS 4,006,936 A 2/1977 Crabiel
4,325,580 A 4/1982 Swisher, Jr. et al.
(Continued)

FOREIGN PATENT DOCUMENTS

AT 382683 B 3/1987
CN 203546575 U 4/2014
(Continued)

OTHER PUBLICATIONS

Caterpillar Operation & Maintenance Manual, PR-1000 Pavement Profiler, Jul. 1990, 78 pages.
(Continued)

*Primary Examiner* — John Kreck
(74) *Attorney, Agent, or Firm* — Lucian Wayne Beavers; Patterson Intellectual Property Law PC

(57) ABSTRACT

In a drum housing for a working drum of a construction machine or mining machine for working off milled material movable in a working direction, said working drum being provided with tools and rotating about a drum axis, with a housing shell that at least partially encloses the circumference of the working drum, and with at least one monitoring device arranged radially outside of the housing shell, said monitoring device inspecting the condition of the working drum or of the tools thereof, it is provided for the following features to be achieved: at least one inspection opening for each monitoring device is arranged in the housing shell, and a partial flow of the milled material passes through the at least one inspection opening during the milling operation and guiding devices conduct the partial flow, in radial direction behind the housing shell, in front of or behind the working drum as seen in the working direction.

20 Claims, 4 Drawing Sheets

(51) Int. Cl.
*E21C 25/06* (2006.01)
*E01C 23/12* (2006.01)

(56) References Cited

U.S. PATENT DOCUMENTS

| | | | | |
|---|---|---|---|---|
| 4,637,753 | A * | 1/1987 | Swisher, Jr. | E01C 23/065 172/112 |
| 4,655,634 | A | 4/1987 | Loy et al. | |
| 4,903,780 | A | 2/1990 | Barbieri | |
| 5,474,397 | A | 12/1995 | Lyons | |
| 6,149,342 | A * | 11/2000 | Phillips | E01C 23/065 404/129 |
| 6,201,567 | B1 | 3/2001 | Kuroda | |
| 6,887,013 | B2 | 5/2005 | Ley et al. | |
| 6,923,508 | B2 | 8/2005 | Holl et al. | |
| 6,990,390 | B2 | 1/2006 | Groth et al. | |
| 7,422,391 | B2 | 9/2008 | Holl et al. | |
| 7,905,682 | B2 | 3/2011 | Holl et al. | |
| 8,386,196 | B2 | 2/2013 | Wagner et al. | |
| 8,794,869 | B2 | 8/2014 | Schlenker et al. | |
| 8,944,518 | B2 * | 2/2015 | von Schoenebeck | E01C 23/088 299/1.5 |
| 9,175,448 | B2 * | 11/2015 | von Schoenebeck | E01C 23/088 |
| 2004/0146353 | A1 | 7/2004 | Ley et al. | |
| 2005/0207841 | A1 | 9/2005 | Holl et al. | |
| 2008/0153402 | A1 | 6/2008 | Arcona et al. | |
| 2010/0076697 | A1 | 3/2010 | Wagner et al. | |
| 2011/0121633 | A1 | 5/2011 | Hall et al. | |
| 2012/0256470 | A1 | 10/2012 | von Schoenebeck | |
| 2013/0087172 | A1 * | 4/2013 | Roetsch | E01C 21/00 134/8 |
| 2013/0197820 | A1 | 8/2013 | Wagner et al. | |
| 2015/0192012 | A1 | 7/2015 | von Schoenebeck | |

FOREIGN PATENT DOCUMENTS

| | | | |
|---|---|---|---|
| DE | 3411892 | A1 | 10/1985 |
| DE | 3218754 | C2 | 11/1985 |
| DE | 3505408 | A1 | 8/1986 |
| DE | 3818213 | A1 | 11/1989 |
| DE | 3921875 | A1 | 1/1991 |
| DE | 10015005 | A1 | 10/2001 |
| DE | 10203732 | A1 | 8/2003 |
| DE | 102005016346 | B3 | 1/2007 |
| EP | 1039036 | A2 | 9/2000 |
| EP | 1396581 | B1 | 3/2004 |
| JP | 941863 | A | 2/1997 |

OTHER PUBLICATIONS

ARRA Basic Asphalt Recycling Manual, U.S. Department of Transportation Federal Highway Administration, 108 pages, 2001.

Liang et al., Vision-Based Automatic Tool Wear Monitoring System, Jun. 25-27, 2008, Proceedings of the 7th World Congress on Intelligent Control and Automation, Chongqing, China, pp. 6031-6035.

European Search Report in EP 12 15 8064, Aug. 2, 2012 (3 pages) (not prior art).

* cited by examiner

DRUM HOUSING FOR A WORKING DRUM OF A CONSTRUCTION MACHINE OR MINING MACHINE, CONSTRUCTION MACHINE OR MINING MACHINE, AS WELL AS METHOD FOR MONITORING THE CONDITION OF A WORKING DRUM OF A CONSTRUCTION MACHINE OR MINING MACHINE

BACKGROUND OF THE INVENTION

1. Field of the Invention

The invention relates to a drum housing for a working drum of a construction machine or mining machine, said working drum being provided with tools and rotating about a drum axis with a specified direction of rotation, a construction machine or mining machine with such drum housing, as well as a method for monitoring the condition of a working drum of a construction machine/mining machine or of the tools thereof arranged on the circumference of the working drum by measuring the condition of the working drum or of the tools thereof by means of a monitoring device.

2. Description of the Prior Art

Such method is known from DE 10 2008 045 470 A1 (U.S. Pat. No. 8,386,196). A monitoring device monitors the condition of the tools of a road milling machine through at least one inspection opening in a housing shell of a drum housing, with said housing shell at least partially enclosing the circumference of the working drum.

The working drum of a construction machine being provided with tools and rotating about a drum axis, for example, a milling drum during the working of road surfaces by means of road milling machines, as well as for the mining of deposits by means of surface miners, is subject to a continuous process of wear and tear, where a tool breakage may also occur. This concerns mainly the tools used, and in particular the milling tools, but also the toolholders. When the tools reach a certain state of wear, it is advisable to replace the tools as the ongoing process will otherwise lose in efficiency. In this regard, a distinction needs to be made between different states of wear which lead to the replacement of a milling tool or milling toolholder respectively:

1. Replacement of the milling tool as there is no longer sufficient wear material, especially carbide metal in the tip. The penetration resistance becomes too great, which leads to the efficiency decreasing as a result of excessive friction loss. Wear and tear is mainly rotationally symmetrical.
2. Replacement of the toolholder as between the milling tool and holder, at the contact surface between these parts, wear and tear in particular of the holder occurs and the wear limit has been reached. This type of wear and tear is usually symmetrical.
3. Non-rotationally symmetrical wear and tear of the milling tool tip and/or the milling tool head caused by insufficient rotational movement of the milling tool during the milling process. This results in a poor milling pattern and the risk of a tool breakage as the supporting effect of the milling tool head is lost.
4. Furthermore, the toolholder may be subject to additional, non-rotationally symmetrical wear and tear.
5. Tool breakage.

Furthermore, worn-out and/or broken milling tools can result in secondary damage to the toolholders, or worn-out toolholders, respectively, can result in secondary damage to the milling drum. Timely replacement of the milling tools and/or toolholders may therefore be necessary and can reduce costs. Replacing the milling tools and/or toolholders too early, on the other hand, also means not working at optimal cost. In such a case, existing wear potential is not utilized appropriately. Previously, without any monitoring device, the state of wear of the milling drum and the tools, namely, the milling tools and toolholders, was assessed by means of a visual check performed by the machine operator. To do so, the machine operator needs to park the machine (turn off engine and uncouple drum from the drive train). He then needs to open the rear drum plate in order to visually inspect the milling drum.

The milling drum is then turned by means of a second drive (auxiliary drive) in order to be able to inspect, section by section, the entire milling drum. The task of inspecting the drum may also be undertaken by a second operator. In the process, the state of wear of the toolholders is usually assessed via so-called wear markings, while the state of wear of the milling tools is assessed via the wear in tool length and the rotational symmetry of the wear pattern.

Checking the state of wear of the milling tool and holder is very time-consuming and reduces the operating time of the machine. In addition, there is the risk, owing to the fact that the assessment is highly subjective in nature, of the state of wear of the holder and milling tool not being assessed correctly and the wear potential therefore not being optimally utilized.

According to the known prior art apparent from FIG. 2, a lens barrel of the inspection camera of the monitoring device is guided into the interior of the drum housing through the housing shell of the drum housing. In addition, it is intended for the monitoring device to be stowed in a protection device during the milling process. The lens barrel inside the drum housing is subject to a high degree of wear and tear caused by the revolving milled material and may be heavily damaged by larger fragments of the milled material. Damage caused to the optics of the camera through the lens barrel can also not be excluded if the camera is not removed during the milling operation. Replacing damaged parts is time-consuming. In addition, mounting times are incurred by the stowing, or mounting respectively, of the monitoring device.

To solve this problem, DE 10 2011 016 271 A proposes to provide inspection openings for a monitoring device in a housing shell of the drum housing, with a closing mechanism being arranged on the outer side of the housing shell that enables closure of the at least one inspection opening.

It has turned out that the milled material revolving in the drum housing during the milling operation builds up a very high pressure which causes the milled material to be hurled against the inner side of the housing shell at high speed so that the closing mechanism can easily be damaged.

SUMMARY OF THE INVENTION

It is therefore the object of the invention to create a drum housing, a construction machine or mining machine, as well as a method for monitoring the condition of a working drum in which a monitoring device can be used at any time, without requiring any mounting effort, and allows savings in time in the inspection of working drums.

The invention specifies a drum housing for a working drum of a construction machine or mining machine for working off milled material and movable in a direction of advance, said working drum being provided with tools and rotating about a drum axis, with a housing shell that at least partially encloses the circumference of the working drum. The drum housing comprises at least one monitoring device arranged radially outside of the housing shell, said monitoring device being able to inspect the condition of the working drum or of the tools thereof through at least one inspection opening arranged in the housing shell.

The invention advantageously provides such an arrangement that a partial flow of the milled material can pass through the at least one inspection opening during the milling operation and that guiding devices conduct the partial flow, in radial direction behind the housing shell, in front of or behind the working drum as seen in the working direction.

The invention facilitates in an advantageous manner for one or several inspection openings in the drum housing to be kept open for the purpose of inspecting the condition of the working drum or the tools thereof. With a partial flow of the milled material being conducted through the inspection openings during the milling operation, deposits are avoided which might block or constrict the inspection openings. The partial flow of the milled material is conducted downwards radially outside of the housing shell or along the housing shell. The partial flow of the milled material passing through the inspection opening in this arrangement is so small that it does not play any role in the machine's operating efficiency. Closing the inspection opening is not required so that the arrangement according to the invention is a simple and cost-efficient design solution for inspecting the condition of the working drum or the tools and toolholders thereof by means of the monitoring device during a stoppage of the machine.

The guiding devices may be formed, for example, by the outer side of the housing shell itself or may comprise devices which are attached to the housing shell or to other parts of the drum housing.

It is particularly preferably intended for the guiding devices for the partial flow of the milled material to comprise at least one wall arranged radially between the at least one inspection opening and the monitoring device and forming a boundary towards the outside, said wall running peripheral to and at a distance from the housing shell and comprising at least one passage opening which is closable during the working operation. The wall is therefore arranged opposite to the at least one inspection opening and protects the monitoring device in the event that the partial flow of the milled material or individual components of the milled material are carried too far out radially.

It is particularly preferably intended for the guiding device to conduct the partial flow of the milled material passing through the inspection openings in front of the working drum as seen in the direction of advance. With the partial flow being conducted in front of the working drum as seen in the direction of advance and the milled material being deposited there, it can be picked up again by the working drum moved forward in the direction of advance without any milled material being lost or remaining in the milling cut.

The housing shell may exhibit, at least on the radially inner side, a curvature radius that is essentially circular or increases in the direction of rotation of the working drum. It is thus achieved that no deposits of the milled material can build up at any point. A self-cleaning effect thus ensues. Owing to manufacturing processes, the housing shell may also exhibit a polygonal cross-section.

As a matter of principle, the distance between the drum axis of the working drum and the housing shell must not exhibit any erratic changes.

Alternatively, it is intended for the distance between the drum axis of the working drum and the housing shell in the specified direction of rotation of the working drum to increase preferably continuously at least over a partial section in order to effect a reduction in pressure in the chamber between the working drum and the drum housing.

It is thus achieved that an as small partial flow as possible can pass through the inspection openings. The small amount of partial flow suffices to keep the inspection opening free from any deposits.

It is intended for the at least one inspection opening to be open permanently and to issue into a channel running downward radially outside of or along the housing shell in the way of a bypass and formed by guiding devices for a partial flow of the milled material.

The channel may comprise at least one radially outer guiding device for the milled material running peripheral or tangential to the housing shell. Said guiding device may consist of, for example, solid walls or also of guiding devices permeable to air which conduct the milled material but are ultimately permeable to air.

The guiding devices for the partial flow of the milled material may comprise at least one radially outer wall or shaft wall forming the boundary of the channel. Said shaft wall may guide the milled material passing through the inspection opening into the channel but may also exhibit such a distance from the housing shell that the kinetic energy of the milled material does not suffice to get into contact with the shaft wall.

In the opened state of the at least one passage opening, inspections can be performed by means of the monitoring device. The monitoring device (for example, at least one inspection camera or one ultrasonic sensor or one scanner and preferably at least one light source, for example, a laser light source) can remain in its mounted state and does not have to be removed during the milling operation. With nothing protruding into the drum housing or no elements having to close the inspection openings, there is nothing that can be damaged during the milling operation. It is possible to clean the working drum, for example, with water prior to the inspection in order to be able to perform the inspection even more effectively on a working drum or the tools thereof freed from dirt. To perform the inspection, the passage opening is opened so that the at least one inspection opening is released for an optical path of the monitoring device. Following completion of the inspection, the at least one passage opening can be closed again by operating a closing mechanism so that the milling operation can be resumed immediately afterwards unless the inspection has resulted in the necessity of a tool replacement.

It is preferably intended for the at least one inspection opening in the housing shell to extend in longitudinal direction of the working drum. In this way, the inspection camera can scan the working drum in a linear fashion in longitudinal direction of the working drum. The light source, provided that such is required, can accordingly also illuminate the working drum in a linear fashion, with the light source being directed at the measuring range of the inspection camera. For example, the at least one inspection opening may extend parallel to the drum axis. With several monitoring devices arranged next to one another, the entire working drum can preferably be scanned in a single line.

A preferred embodiment of the invention intends for the at least one inspection opening to widen radially towards the working drum. Such design of the inspection opening facilitates keeping the inspection opening free from any deposits.

The monitoring device comprises at least one sensor device, for example, an inspection camera, and preferably one illuminating device, wherein the at least one inspection opening and the at least one passage opening may each exhibit at least one first opening for the sensor device and, where appropriate, at least one second opening for the illuminating device.

The at least one closable passage opening may comprise a closing mechanism with a sliding plate closing the passage opening.

Several inspection openings and accompanying monitoring devices with passage openings may be arranged next to one another across the width of the working drum. This is of advantage especially in wide working drums with a working width of, for example, more than half a meter in length.

The monitoring device may be arranged at the channel or at the radially outer shaft wall. For example, the monitoring device may be attached to the radially outer wall or shaft wall in which arrangement the closing mechanism for the passage openings may be arranged between the monitoring device and the outer shaft wall.

It is preferably intended for the at least one inspection opening in the cross-section of the drum housing to be circumferentially arranged in an upper segment of the housing shell. In an upper segment of the housing shell means, for example, in an angular range of between 30° and 150° measured along a horizontal line through the axis of the working drum, preferably in an angular range of between 50° and 130°.

The invention is suitable for use, for example, in road milling machines or recyclers or stabilizers or surface miners or, generally speaking, in construction machines or mining machines with working drums the condition of which, including the condition of the tools, is to be inspected.

The invention also specifies a method for monitoring the condition of a working drum of a construction machine, or mining machine respectively, movable in the direction of advance, or of the tools thereof arranged on the circumference of the working drum. The condition of the working drum or of the tools thereof is measured by means of a monitoring device through at least one inspection opening in a housing shell of a drum housing, with said housing shell at least partially enclosing the circumference of the working drum.

The method is characterized by keeping the at least one inspection opening free from any deposits of the milled material during the working operation of the working drum by allowing a partial flow of the milled material worked off to pass through the at least one inspection opening, feeding the partial flow into a channel, conducting the partial flow away downwards via the channel and, during an interruption of the working operation in which the working drum is not engaged with a surface to be worked, performing the condition measurement through the inspection opening kept free from any deposits.

The method can be performed with ease in an advantageous fashion and requires a minimum of movable parts so that the method can be performed cost-efficiently, in a time-saving manner and at low costs of maintenance. The required stoppages of the machine are also reduced to a minimum.

It is preferably intended for the channel to conduct the partial flow of the milled material in front of the working drum as seen in the direction of advance. There, due to the working progress of the machine, the deposited milled material can be picked up again by the working drum. As the amount of partial flow is relatively small, the operation efficiency of the machine is not impaired.

In an advantageous further development, it is intended for the measuring beams of the monitoring device to be allowed to pass through a passage opening of the channel to the monitoring device, said passage opening being closable during the working operation.

In this arrangement, closing or opening of the at least one passage opening is effected by means of drive mechanisms which can be operated by remote control from the operator's platform of the construction machine or mining machine, respectively.

In the following, one embodiment of the invention is explained in greater detail with reference to the drawings.

BRIEF DESCRIPTION OF THE DRAWINGS

The following is shown.

DETAILED DESCRIPTION

Figure 1:
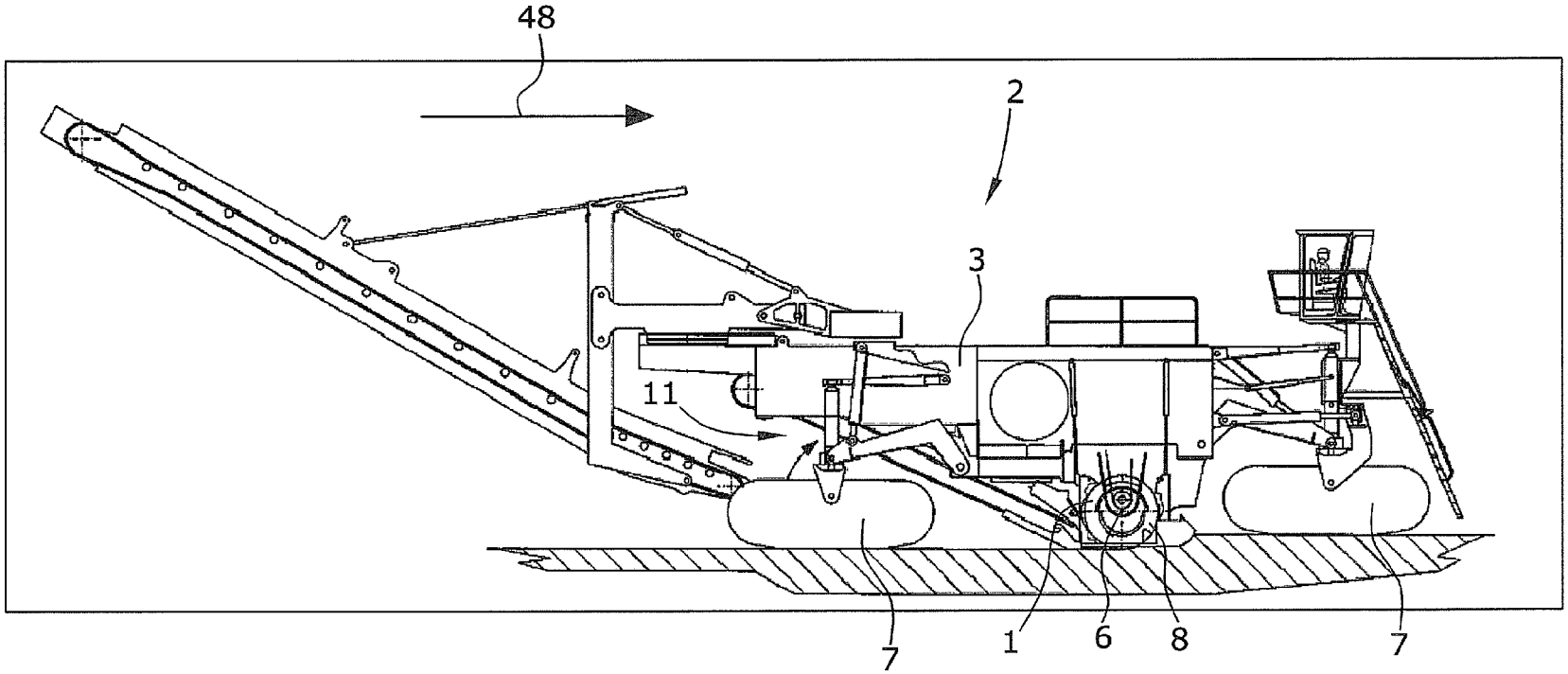
FIG. 1 an example of a construction machine in the design of a surface miner, FIG. 2 a drum housing with monitoring device in accordance with prior art, FIG. 3 the monitoring device directed at the working drum, FIG. 4 a perspective view of a part of the drum housing, FIG. 5 a perspective view of several inspection openings across the width of the drum housing, and FIG. 6 a perspective view of the channel outlet at the drum housing and of the monitoring device above the channel.

FIG. 1 shows an example of a construction machine 2 in the design of a surface miner for the milling of ground surfaces or traffic surfaces. The surface miner comprises a chassis with, for example, four tracked ground-engaging units 7, said chassis supporting the machine frame 3 of the surface miner. It is understood that, in the case of road milling machines, soil stabilizers and recyclers, the tracked ground-engaging units 7 may be substituted wholly or in part by wheeled ground-engaging units.

A working drum 8 rotating about a drum axis 6 is supported in the machine frame 3 in the design of a milling drum fitted with tools 4, said working drum 8 extending transversely to the working direction 48 of the construction machine 2. The working drum 8 is partially enclosed by a drum housing 1. Adjustment of the milling depth is preferably effected by means of the height adjustment 11 of the tracked ground-engaging units 7 but may also be effected by means of a height-adjustable working drum 8.

It is understood that the construction machine 2 with a working drum 8 and drum housing 1 may also consist of other machines, such as road milling machines, soil stabilizers, cold recyclers, recycling machines.

Figure 2:
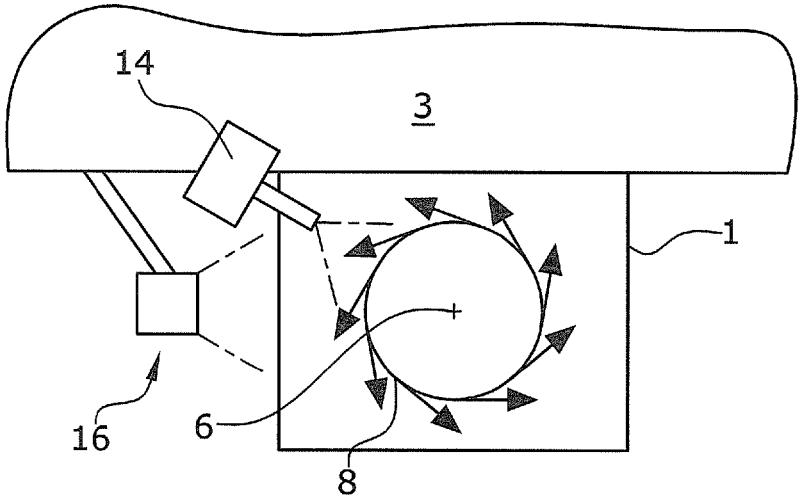
Fig.2 (prior art)

FIG. 2 shows a monitoring device 15 at a drum housing 1 with a sensor device 14, for example, an inspection camera, and a light source 16. The inspection camera 14 protrudes, with a lens barrel, through the drum housing 1 into the chamber enclosing the working drum 8 inside the drum housing 1.

Figure 3:
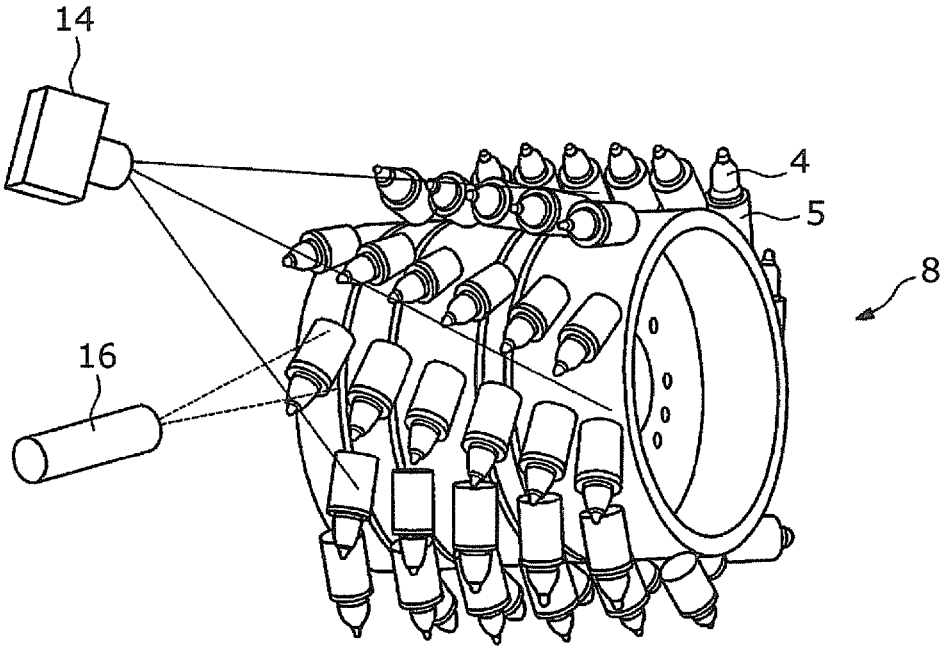
Fig.3 (prior art)

FIG. 3 shows the working drum 8 fitted with tools 4, where the replaceable tools 4 are mounted in toolholders 5. The arrangement of the inspection camera 14 and the illuminating device 16 is illustrated schematically. It is understood that the illuminating device 16 illuminates the working drum 8 to be inspected, or the tools 4 and toolholders 5 thereof respectively, in that area in which the sensor device 14 in the design of an inspection camera captures the objects to be monitored. The illuminating device 16 can be omitted if sufficient light is available for condition monitoring (inspection) or if no illumination is generally necessary for the monitoring device. The monitoring device may alternatively consist of, for example, an ultrasonic sensor or of, for example, a scanner, preferably a laser scanner.

With respect to an inspection procedure to be performed, reference is made to DE 10 2008 045 470 (U.S. Pat. No. 8,386,196), the full disclosure content of which is incorporated herein by reference.

Figure 4:
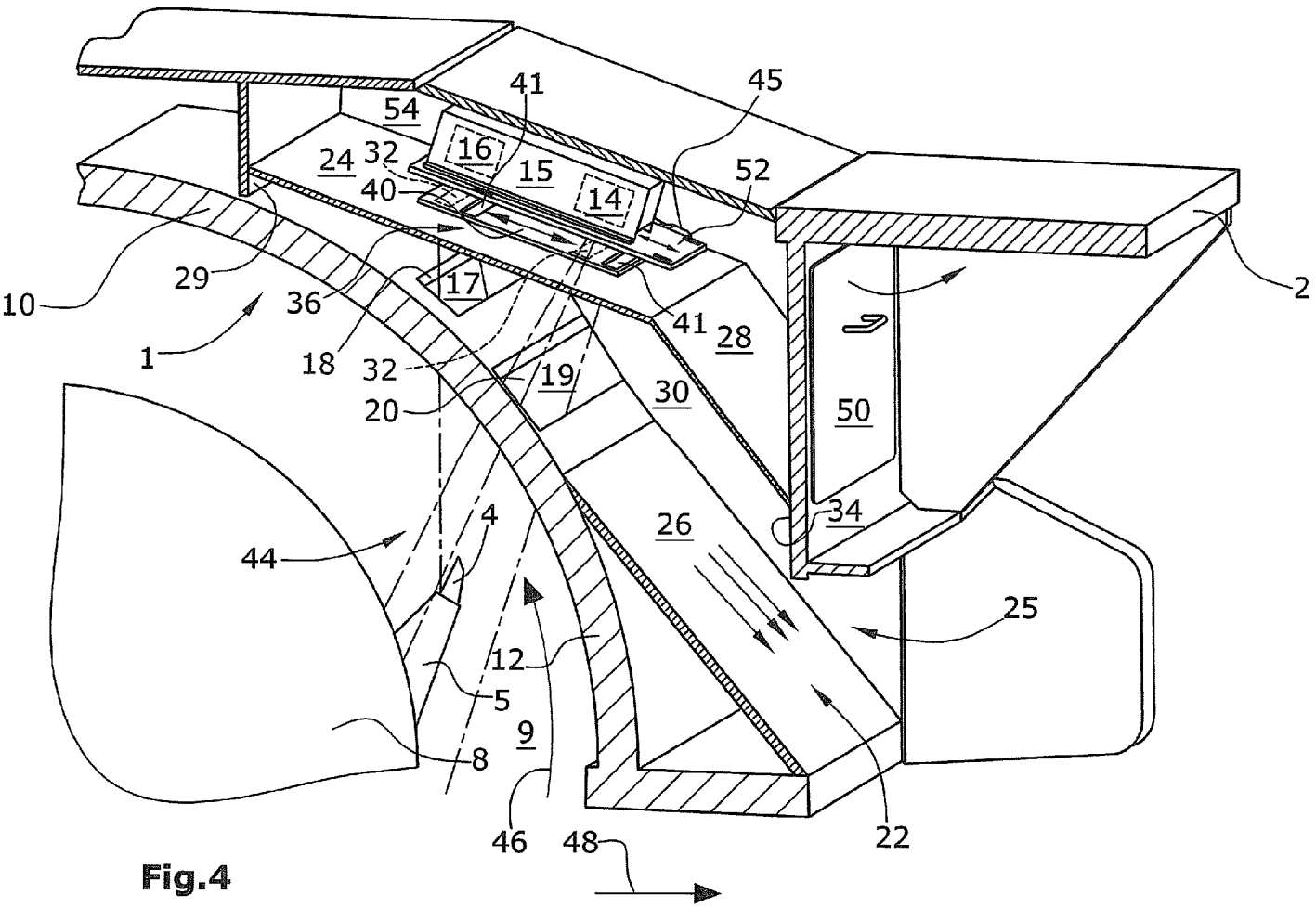

FIG. 4 shows a perspective view of an embodiment of the invention partly in a cross-sectional view. The working drum 8 is supported in the drum housing 1 in end walls 9 lying opposite to one another. The curvature of the housing shell 10 of the drum housing 1 is preferably circular or increasing in the direction of rotation 46 of the working drum 8. It is understood that, strictly speaking, such curvature radius is only required for the inner shell surface 12 of the housing shell 10.

A first inspection opening 20 is arranged in the housing shell 10, with the measuring beams 19 of a monitoring device 15 being able to pass through said inspection opening 20 in order to be able to inspect the working drum 8 and in particular the toolholder 5 and tool 4 thereof. To this effect, the monitoring device 15 comprises at least one sensor device 14 which may consist of, for example, an ultrasonic sensor or a camera.

Furthermore, the monitoring device 15 may also include a light source 16 or a lighting system, preferably a laser light source. To this effect, a second inspection opening 18 may be located in the housing shell 10 to allow the passing through of light beams 17, in particular of laser light beams.

The inspection openings 18, 20 issue into a channel 22 which, on the outer circumference of the housing shell 10, is partly peripheral and partly tangential in design, with a radially outer wall 24 as shaft wall, the shaft wall 28 as well as the end wall 34 forming the boundary of said channel 22 in radially outward direction. In parallel direction to the working drum 8, side walls 30, only one of which is shown in FIG. 4, form the lateral boundary of the channel 22 on both sides. In the direction of rotation 46 of the working drum 8, the end wall 29 forms the boundary of the channel 22, where said end wall 29 may alternatively also be arranged close to the inspection opening 18. In the area of the inspection openings 18, 20, the radially inner boundary of the channel 22 is formed by the housing shell 10 and, in the further course against the direction of rotation 46, may comprise a chute 26. On the chute 26, the milled material entering through the inspection opening 18, 20 can be discharged in front of the drum housing 1 as seen in the working direction 48 of the machine.

The radially outer wall 24, which lies opposite to the inspection openings 18, 20, exhibits passage openings 32 for the light beams 17 or the measuring beams 19, respectively, where said passage openings 32 can be closed by means of a closing mechanism 36 during the working operation of the machine so that no milled material or dust can reach the monitoring device 15.

The closing mechanism 36 comprises a sliding plate 40 which is provided with two openings 41 corresponding to the passage openings 32 in the wall 24. The sliding plate 40 with the openings 41 can be brought into a closed position for the milling operation apparent from FIG. 4 by means of a piston-cylinder unit 45, in which position the passage openings 32 are covered by the sliding plate 40. For inspection of the working drum 8, the plate 40 can be moved into a position in which the passage openings 41 are located precisely above the passage openings 32 for the light beam 17 and measuring beam 19 depicted as dashed lines in FIG. 4.

The inspection openings 18, 20 remain open during the milling operation so that a partial flow of the milled material can pass through the inspection openings 18, 20. This also has a self-cleaning effect so that no permanent deposits remain in the inspection openings 18, 20 when the machine discontinues its working operation. In this way, the inspection openings 18, 20 are available for inspection at all times without requiring previous cleaning.

The milled material having passed through the inspection opening 18, 20 moves downward along the chute 26 by reason of gravity alone so that it can be travelled over and picked up once again by the working drum 8 during the milling operation.

The monitoring device 15 is mounted, at a distance from the wall 24, on an adjustment plate 52 by means of which a precise alignment of the monitoring device 15 can be made. If the adjustment plate 52 has been adjusted correctly, the monitoring device 15 can be exchanged, should the need arise, without the adjustment procedure having to be performed again.

Figure 5:
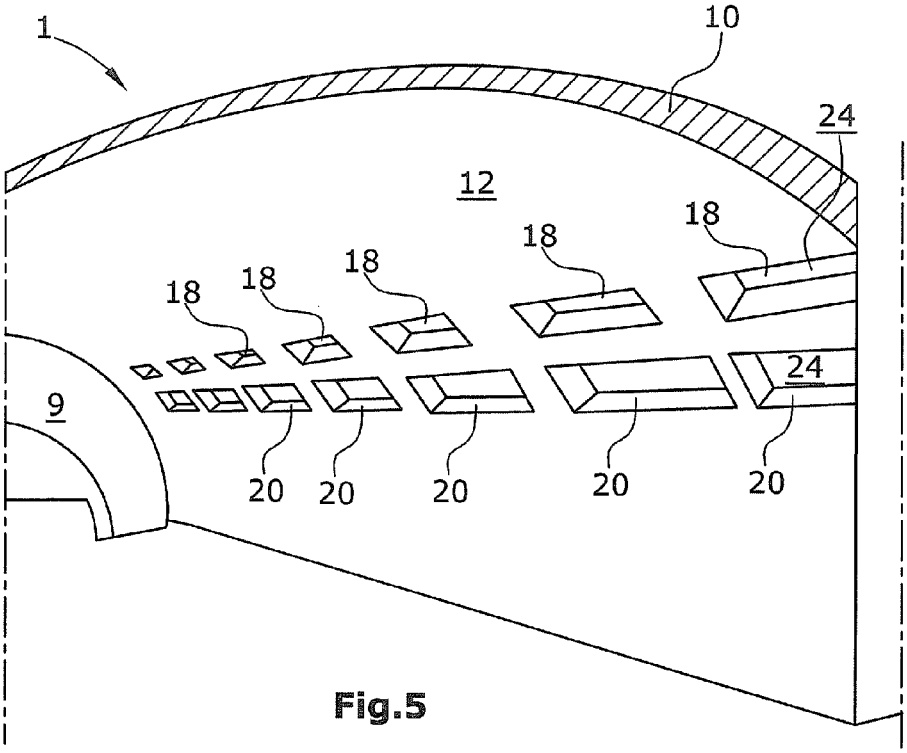

FIG. 5 shows a perspective view of the inner shell surface 12 of the housing shell 10 with several inspection openings 18, 20 arranged next to one another and aligned parallel to the drum axis 6. One monitoring device 15 is assigned to each pair of inspection openings 18, 20 so that even very large workings widths of a working drum 8 can be monitored completely by means of several monitoring devices 15.

Figure 6:
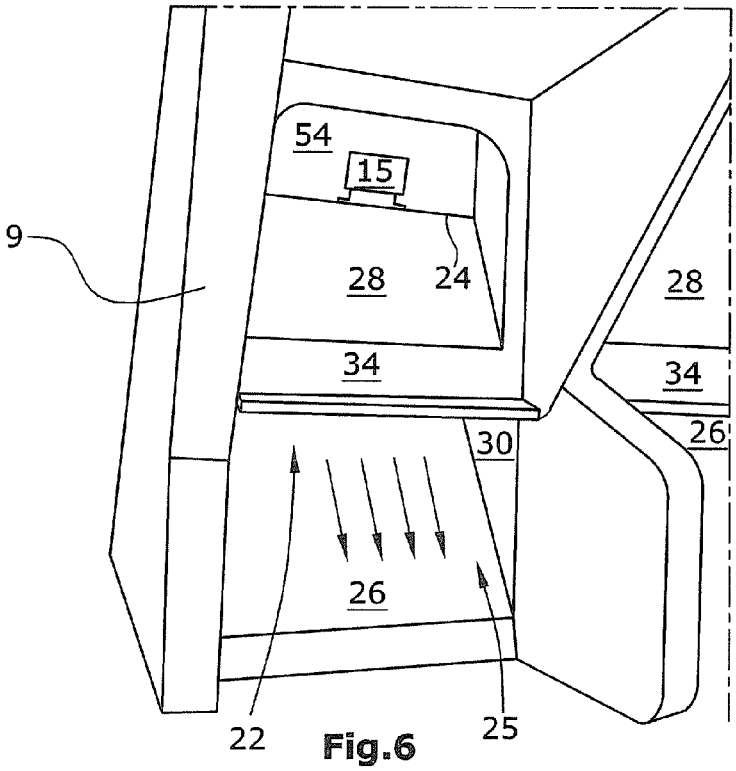

FIG. 6 shows a perspective view of the discharge opening 25 of the channel 22. Above the channel 22, the monitoring device 15 can be seen in a chamber 54 which is lockable by a door 50, said chamber 54 finishing radially inwards with the wall 24 and the shaft wall 28.

What is claimed is:

1. A construction machine or mining machine, comprising:

a working drum including a plurality of tools, the working drum rotatable about a drum axis;

a drum housing shell at least partially enclosing a circumference of the working drum, the drum housing shell including an inspection opening; and an outer wall located radially outward from the drum housing shell and defining a channel communicated with the inspection opening, the channel extending downward outside of the drum housing shell, the outer wall having a wall opening defined therein.

2. The machine of claim 1, further comprising:

a monitoring device located outside of the outer wall and oriented to monitor the working drum through the wall opening and the inspection opening.

3. The machine of claim 2, wherein:

the monitoring device includes a sensor and an illuminating source; and the inspection opening includes first and second inspection openings aligned with the sensor and the illuminating source, respectively.

4. The machine of claim 2, further comprising:

an enclosure located radially outward of the outer wall, the monitoring device being located in the enclosure; and an access door communicated with the enclosure.

5. The machine of claim 1, wherein:

the channel has an exit opening directed in front of the working drum in a direction of working travel of the machine.

6. The machine of claim 1, further comprising:

a closure configured to selectively open and close the wall opening.

7. The machine of claim 1, wherein:

the inspection opening is permanently open.

8. The machine of claim 1, wherein:

the drum housing shell includes a plurality of inspection openings spaced apart across a width of the working drum, the plurality of inspection openings including the first mentioned inspection opening.

9. The machine of claim 1, wherein:

the inspection opening is circumferentially arranged in an upper segment of the housing shell.

10. The machine of claim 9, wherein:

the inspection opening is circumferentially arranged in an annular range of between 30° and 150° relative to a horizontal line through the axis of the working drum.

11. The machine of claim 10, wherein:

the annular range is between 50° and 130°.

12. The machine of claim 1, wherein:

the inspection opening and the channel are configured such that the inspection opening remains sufficiently open due to the partial flow of milled material through the inspection opening during working operation of the working drum, such that upon ceasing of working operation the working drum can be monitored through the inspection opening.

13. A construction machine or mining machine, comprising:

a working drum including a plurality of tools, the working drum rotatable about a drum axis;

a drum housing shell at least partially enclosing a circumference of the working drum, the drum housing shell including a permanently open inspection opening; and an outer wall located radially outward from the drum housing shell, the outer wall having a wall opening defined therein, the wall opening being sufficiently aligned with the inspection opening such that the working drum can be monitored from outside of the outer wall through the wall opening and the inspection opening; and a closure configured to selectively open and close the wall opening.

14. The machine of claim 13, further comprising:

a monitoring device located outside of the outer wall and oriented to monitor the working drum through the wall opening and the inspection opening.

15. The machine of claim 14, wherein:

the monitoring device includes a sensor and an illuminating source; and the inspection opening includes first and second inspection openings aligned with the sensor and the illuminating source, respectively.

16. The machine of claim 14, further comprising:

an enclosure located radially outward of the outer wall, the monitoring device being located in the enclosure; and an access door communicated with the enclosure.

17. The machine of claim 13, wherein:

the inspection opening is configured such that the inspection opening remains sufficiently open due to the partial flow of milled material through the inspection opening during working operation of the working drum, such that upon ceasing of working operation the working drum can be monitored through the inspection opening.

18. The machine of claim 14, wherein:

the inspection opening is circumferentially arranged in an upper segment of the housing shell.

19. The machine of claim 18, wherein:

the inspection opening is circumferentially arranged in an annular range of between 30° and 150° relative to a horizontal line through the axis of the working drum.

20. The machine of claim 14, wherein:

the outer wall partially defines a channel communicated with the inspection opening, the channel extending downward in front of the drum housing shell.

* * * * *